US007062793B2

(12) United States Patent
Liao

(10) Patent No.: US 7,062,793 B2
(45) Date of Patent: Jun. 20, 2006

(54) HAT HAVING FOLDABLE FLAP

(76) Inventor: Sung Yie Liao, P.O. Box 63-99, Taichung (TW) 406

( * ) Notice: Subject to any disclaimer, the term of this patent is extended or adjusted under 35 U.S.C. 154(b) by 156 days.

(21) Appl. No.: 10/790,419

(22) Filed: Feb. 26, 2004

(65) Prior Publication Data

US 2005/0188448 A1 Sep. 1, 2005

(51) Int. Cl.
*A42B 1/06* (2006.01)

(52) U.S. Cl. ..... 2/172; 2/209.11; 2/209.13; 2/209.12; 2/195.1

(58) Field of Classification Search ..... 2/172, 2/209.13, 209.11, 195.1, 175.1, 171.03, 175.4, 2/200.1, 200.2, 174, 171.6, 173.5; D2/891
See application file for complete search history.

(56) References Cited

U.S. PATENT DOCUMENTS 8,602 A * 12/1851 Girbardt ..... 415/206
239,187 A * 3/1881 Neuman ..... 2/172
251,572 A * 12/1881 Goldman ..... 2/172
948,273 A * 2/1910 Finestone et al. ..... 2/172
1,364,662 A * 1/1921 Wagner ..... 2/410
1,718,867 A 6/1929 Mahlmann
6,209,139 B1 * 4/2001 Schmidt et al. ..... 2/171.1
6,243,876 B1 * 6/2001 Provenzano et al. ..... 2/172

* cited by examiner

*Primary Examiner*—John J. Calvert
*Assistant Examiner*—Richale L. Haney
(74) *Attorney, Agent, or Firm*—Charles E. Baxley

(57) ABSTRACT

A hat includes a crown having an outer peripheral surface, and one or more flaps each having an inner peripheral surface and an outer peripheral surface, and each having an edge portion attached to the outer peripheral surface of the crown with an attaching line. The flaps are foldable relative to the crown to have either of the inner peripheral surface or the outer peripheral surface of the flaps to be selectively engaged onto the outer peripheral surface of the crown or to be exposed outwardly. The attaching lines of the flaps may be partially superposed with the each other. The flaps may be partially superposed with the each other.

4 Claims, 7 Drawing Sheets

HAT HAVING FOLDABLE FLAP

BACKGROUND OF THE INVENTION

1. Field of the Invention

The present invention relates to a hat, and more particularly to a hat having one or more flaps foldable relative to the crown, for such as decorative purposes.

2. Description of the Prior Art

Typical hats comprise a crown, and a shade provided or attached to the front portion of the crown for sun shading purposes.

For example, U.S. Pat. No. 1,718,867 to Mahlmann discloses one of the typical hats and includes a folding eyeshade attached to the front portion of the crown for sun shading purposes.

Normally, the crowns of the hats includes an integral structure having no foldable flaps provided thereon.

The present invention has arisen to mitigate and/or obviate the afore-described disadvantages of the conventional hats.

SUMMARY OF THE INVENTION

The primary objective of the present invention is to provide a hat including one or more flaps foldable relative to the crown, for such as decorative purposes.

In accordance with one aspect of the invention, there is provided a hat comprising a crown including an outer peripheral surface, and a first flap including an inner peripheral surface and an outer peripheral surface, and including an edge portion attached to the outer peripheral surface of the crown with an attaching line. The first flap is foldable relative to the crown to have either of the inner peripheral surface or the outer peripheral surface of the first flap to be selectively engaged onto the outer peripheral surface of the crown or to be exposed outwardly.

A second flap may further be provided and include an inner peripheral surface and an outer peripheral surface, and including an edge portion attached to the outer peripheral surface of the crown with an attaching line, the second flap being foldable relative to the crown to have either of the inner peripheral surface or the outer peripheral surface of the second flap to be selectively engaged onto the outer peripheral surface of the crown or to be exposed outwardly.

The attaching line of the second flap is partially superposed with the attaching line of the first flap. The outer peripheral surface of the second flap is engageable onto the inner peripheral surface of the first flap when the second flap is folded relative to the first flap.

A third flap may further be provided and include an inner peripheral surface and an outer peripheral surface, and including an edge portion attached to the outer peripheral surface of the crown with an attaching line, the third flap being foldable relative to the crown to have either of the inner peripheral surface or the outer peripheral surface of the third flap to be selectively engaged onto the outer peripheral surface of the crown or to be exposed outwardly. The attaching line of the third flap is partially superposed with the attaching lines of the first and the second flaps.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
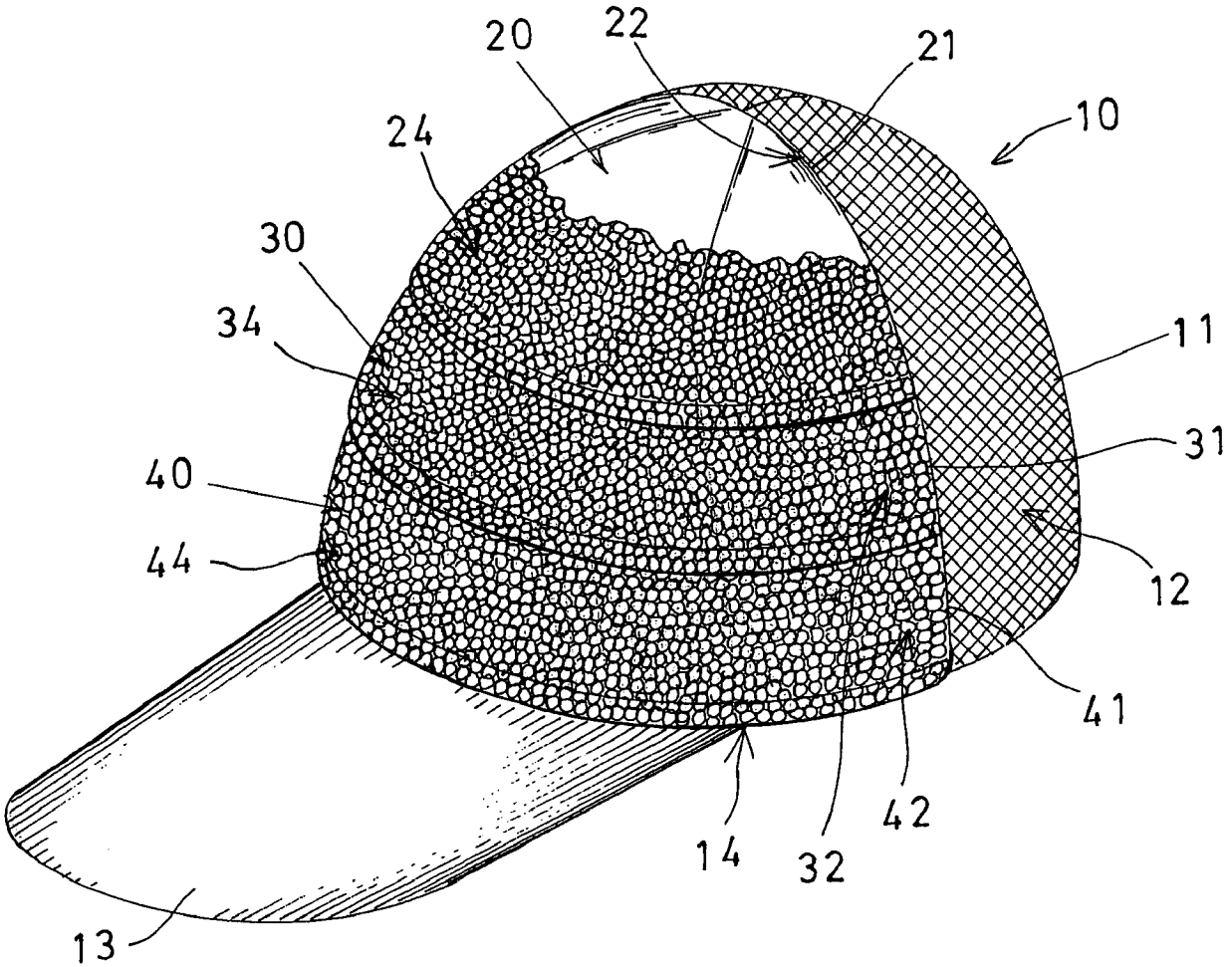
FIG. 1 is a perspective view of a hat in accordance with the present invention.

Referring to the drawings, and initially to FIG. 1, a hat 10 in accordance with the present invention comprises a crown 11 having an outer peripheral surface 12. The hat 10 may preferably or selectively comprise a shade 13 attached to the front portion 14 of the crown 11, for sun shading purposes.

Figure 2:
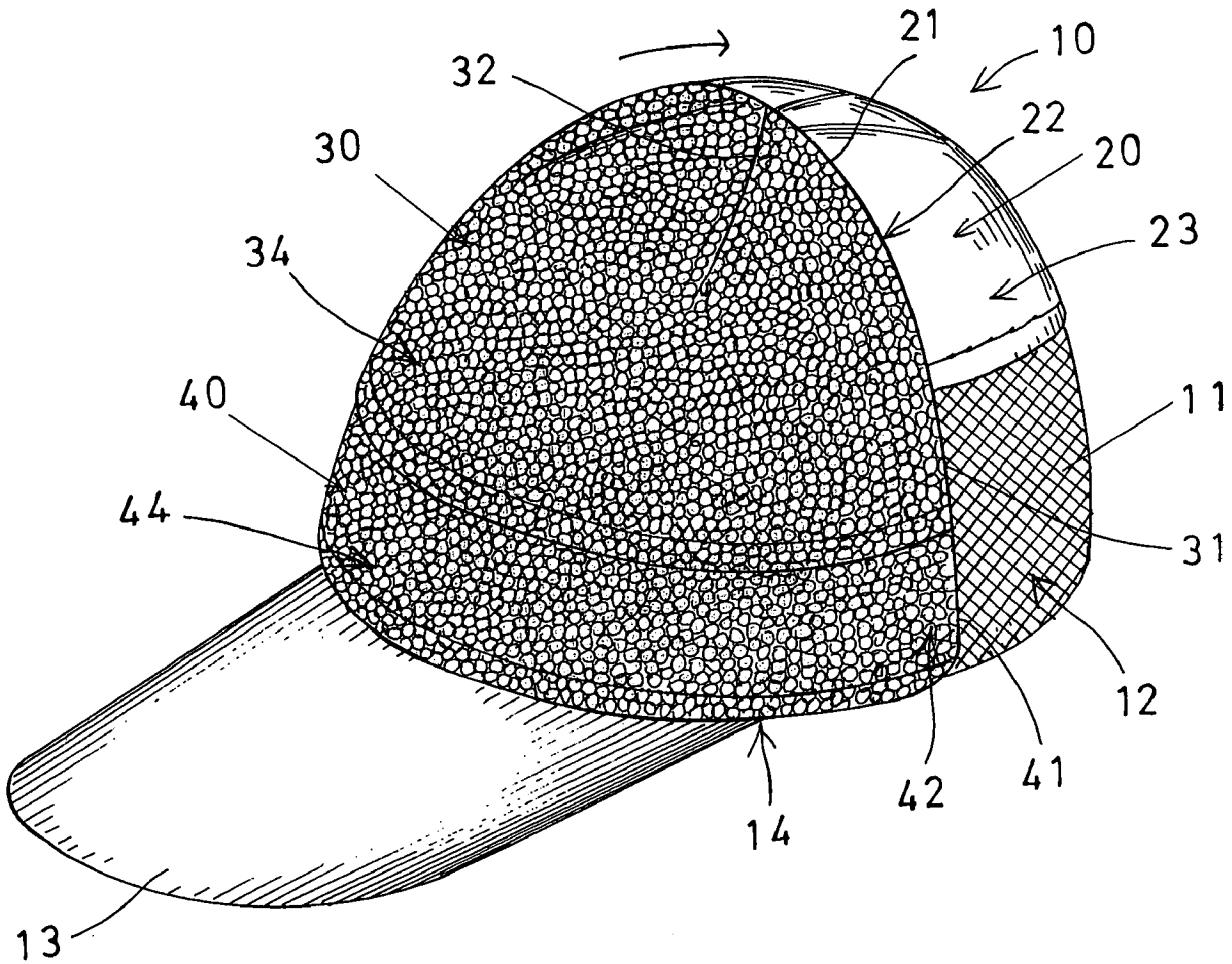
FIGS. 2, 3, 4 are perspective views similar to FIG. 1, illustrating the operation of the hat.
Figure 3:
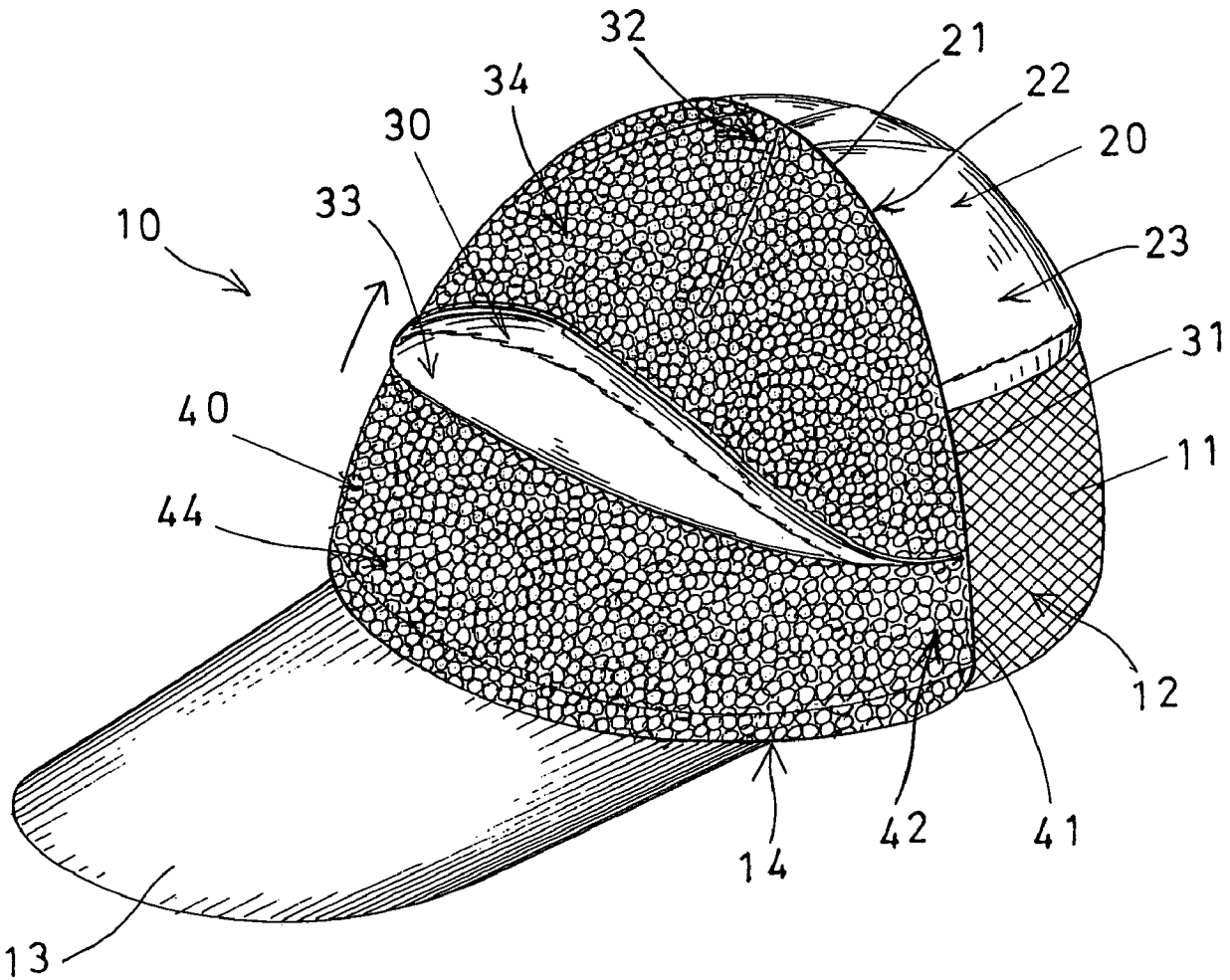

The hat 10 further includes one or more, such as three flaps 20, 30, 40, as shown in FIGS. 1–3, attached onto the outer peripheral surface 12 of the crown 11, with securing or attaching lines 21, 31, 41 respectively. The securing or attaching lines 21, 31, 41 of the flaps 20, 30, 40 may be partially superposed with each other.

For example, each of the flaps 20, 30, 40 includes an edge portion 22, 32, 42 secured or attached onto the outer peripheral surface 12 of the crown 11, with the securing or attaching lines 21, 31, 41 respectively, and arranged to have the inner peripheral surface 23, 33, 43 of the flaps 20, 30, 40 (FIGS. 2–4) to be engaged onto the outer peripheral surface 12 of the crown 11 (FIG. 1).

Figure 4:
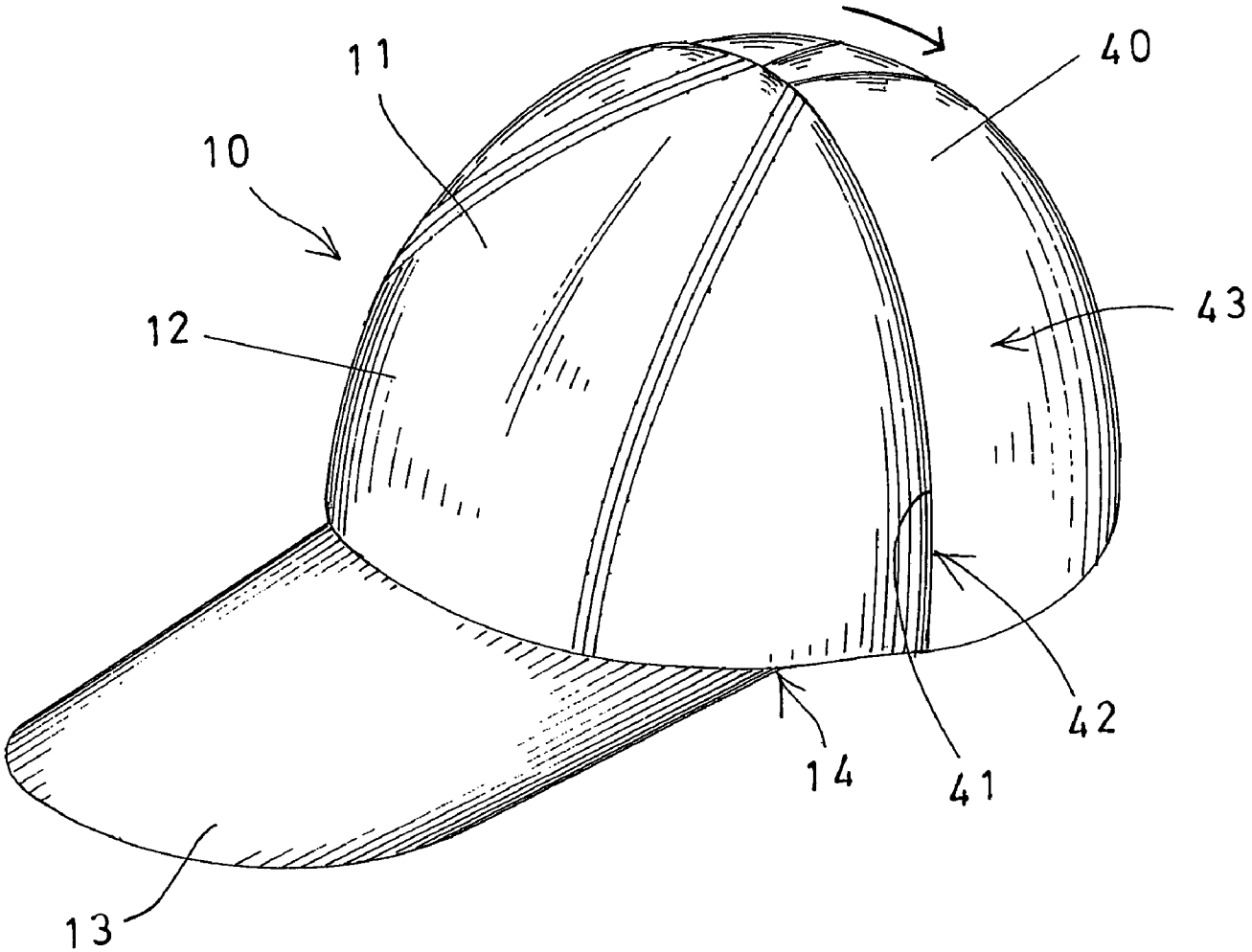

As shown in FIGS. 2–4, the flaps 20, 30, 40 are arranged to be foldable and to have the outer peripheral surface 24, 34, 44 of the flaps 20, 30, 40 to be selectively folded and engaged onto the outer peripheral surface 12 of the crown 11.

For example, as shown in FIG. 1, the inner peripheral surface 23, 33, 43 of the flaps 20, 30, 40 may be engaged onto the outer peripheral surface 12 of the crown 11, to have the outer peripheral surface 24, 34, 44 of the flaps 20, 30, 40 to be exposed outwardly or to be seen by users.

As shown in FIG. 2, the flap 20 may be folded to have the outer peripheral surface 24 thereof engaged onto the outer peripheral surface 12 of the crown 11, and thus to have the inner peripheral surface 23 thereof to be exposed outwardly or to be seen by users. The flaps 20, 30, 40 may be partially superposed with each other.

Alternatively, as shown in FIGS. 3 and 4, the other flaps 30, 40 may also be selectively folded to have the outer peripheral surface 34, 44 thereof engaged onto the outer peripheral surface 12 of the crown 11 and/or the inner peripheral surface 23 of the flap 20, and thus to have the inner peripheral surfaces 33, 43 of the flaps 30, 40 to be exposed outwardly or to be seen by users.

The surfaces 23, 24, 33, 34, 43, 44 of the flaps 20, 30, 40 may thus be applied with various kinds of patterns or marks or figures thereon, and may be selectively exposed outwardly for such as decorative or marketing purposes.

Figure 5:
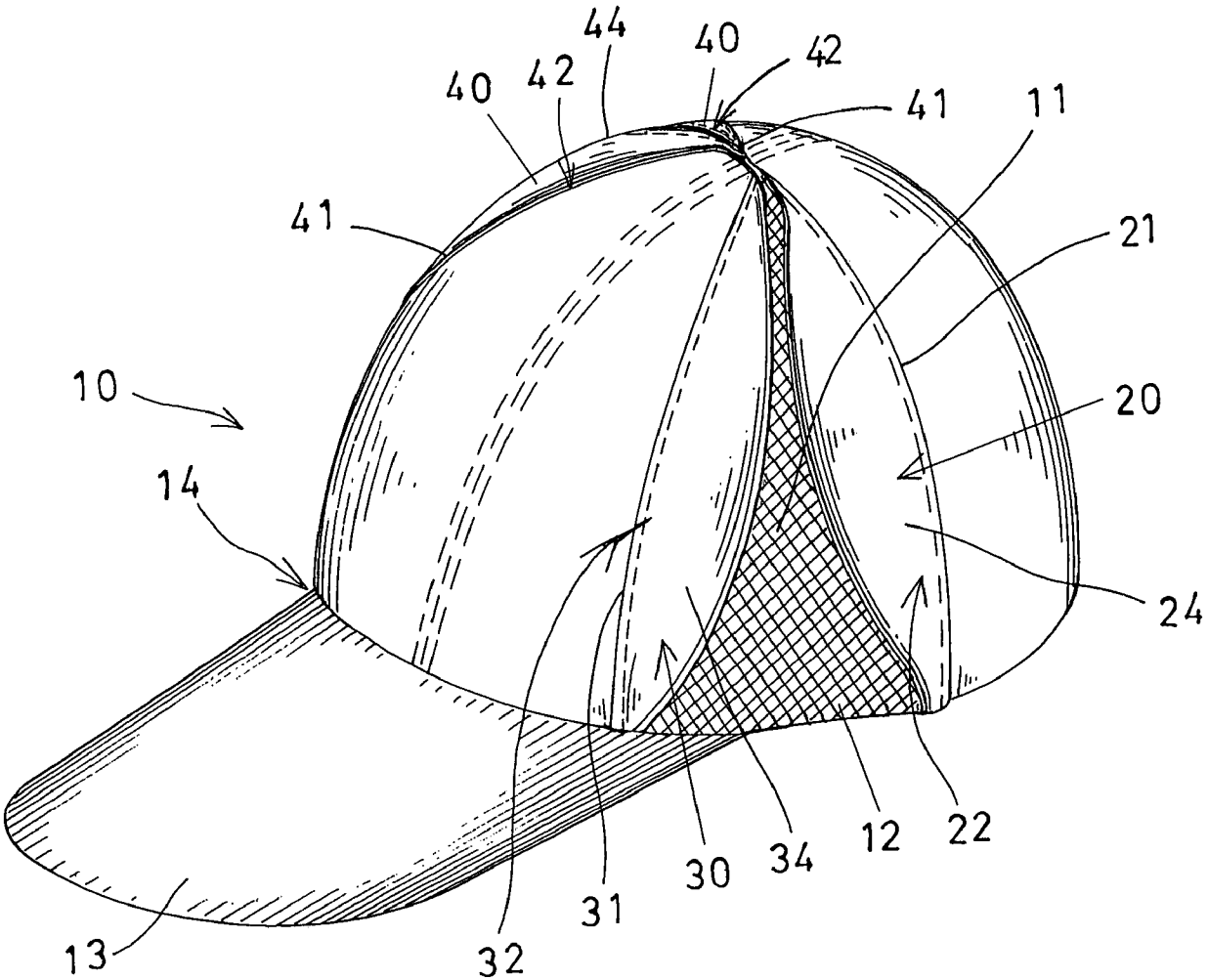
FIG. 5 is a perspective view similar to FIGS. 1–4, illustrating the other arrangement of the hat.
Figure 6:
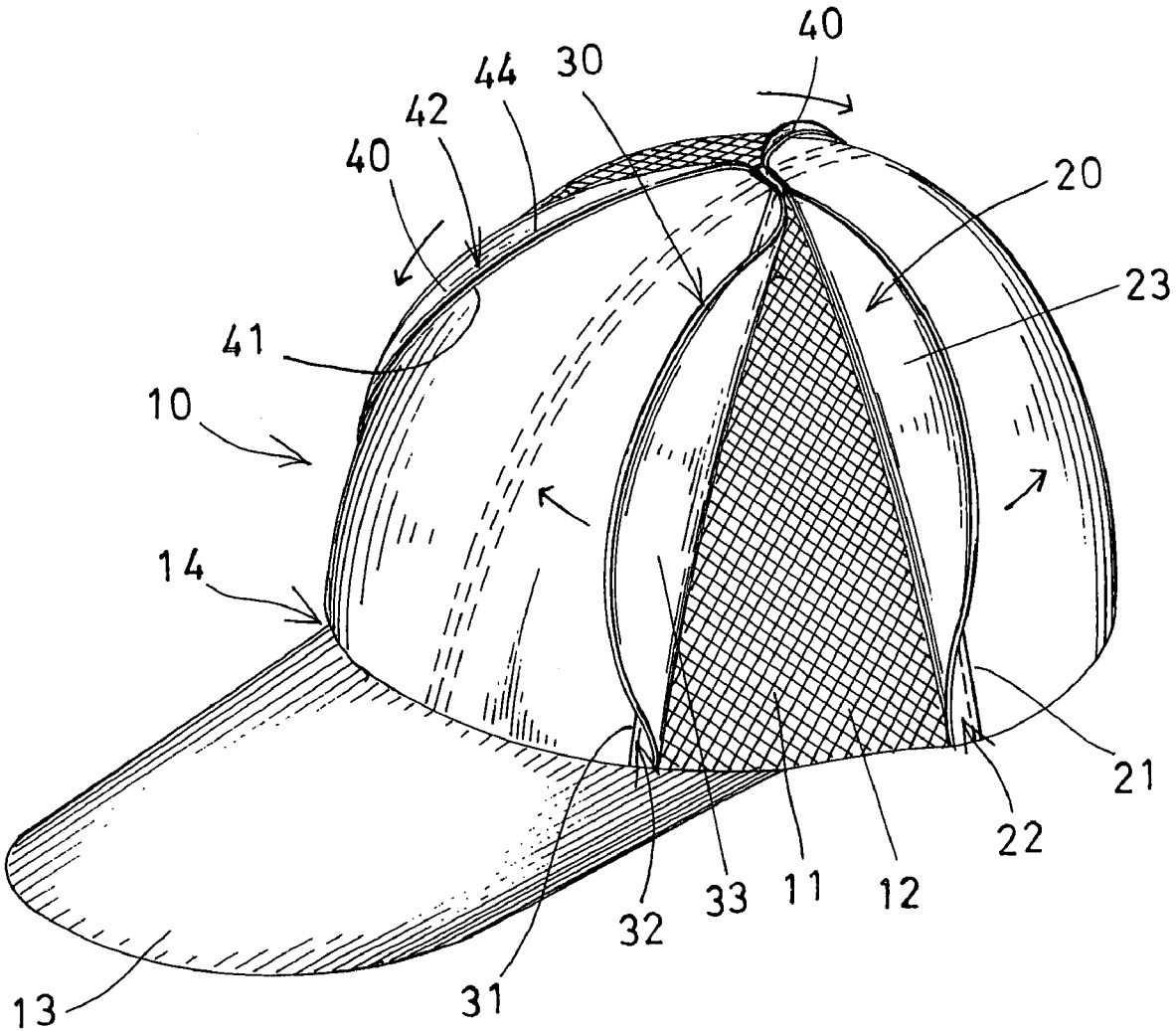
FIGS. 6 and 7 are perspective views similar to FIG. 5, illustrating the operation of the hat as shown in FIG. 5.
Figure 7:
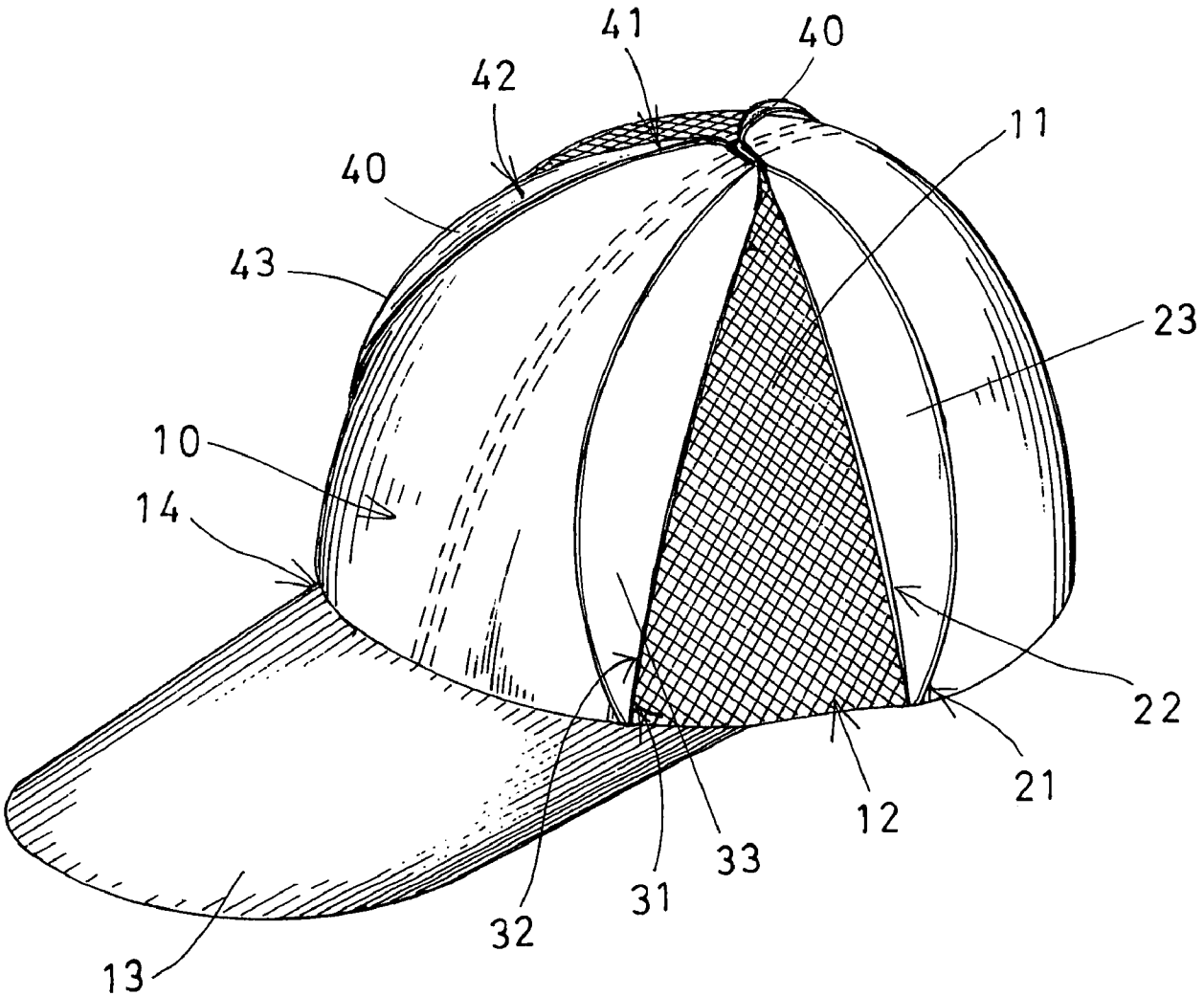

Alternatively, as shown in FIGS. 5–7, the edge portion 22, 32, 42 of the flaps 20, 30, 40 may be secured onto the outer peripheral surface 12 of the crown 11 at different positions or with securing or attaching lines 21, 31, 41 at different portions the outer peripheral surface 12 of the crown 11, and arranged to allow the flaps 20, 30, 40 to be foldable relative to the crown 11, and to have the inner and the outer peripheral surfaces 23, 24, 33, 34, 43, 44 of the flaps 20, 30, 40 to be selectively exposed outwardly or seen by users.

Accordingly, the hat in accordance with the present invention includes one or more flaps foldable relative to the crown, for such as decorative purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hat comprising:

a crown including an outer peripheral surface, a first flap including an inner peripheral surface and an outer peripheral surface, and including an edge portion attached to said outer peripheral surface of said crown with a securing line, said first flap being foldable relative to said crown to have either of said inner peripheral surface or said outer peripheral surface of said first flap to be selectively engaged onto said outer peripheral surface of said crown or to be exposed outwardly, a second flap including an inner peripheral surface and an outer peripheral surface, and including an edge portion attached to said outer peripheral surface of said crown with a securing line, said second flap being foldable relative to said crown to have either of said inner peripheral surface or said outer peripheral surface of said second flap to be selectively engaged onto said outer peripheral surface of said crown or to be exposed outwardly, and a third flap including an inner peripheral surface and an outer peripheral surface, and including an edge portion attached to said outer peripheral surface of said crown with a securing line, said third flap being foldable relative to said crown to have either of said inner peripheral surface or said outer peripheral surface of said third flap to be selectively engaged onto said outer peripheral surface of said crown or to be exposed outwardly.

2. The hat as claimed in claim 1, wherein said securing line of said second flap is partially secured to said securing line of said first flap.

3. The hat as claimed in claim 1, wherein said outer peripheral surface of said second flap is engageable onto said inner peripheral surface of said first flap when said second flap is folded relative to said first flap.

4. The hat as claimed in claim 1, wherein said securing line of said third flap is partially secured to said securing lines of said first and said second flaps.

* * * * *